US005806652A

United States Patent [19]

Johnson et al.

[11] Patent Number: 5,806,652

[45] Date of Patent: Sep. 15, 1998

[54] TAMPER-RESISTANT ANTI-THEFT GUARD FOR COIN COLLECTION

[75] Inventors: Elizabeth Johnson, Hillsborough; Richard Richroath, Morganville; Joseph Lentini, Hazlet; Robert Torode, Point Pleasant, all of N.J.

[73] Assignee: New Jersey Highway Authority, Woodbridge, N.J.

[21] Appl. No.: 714,316

[22] Filed: Sep. 18, 1996

[51] Int. Cl.[6] ..... G07F 1/04

[52] U.S. Cl. ..... 194/347; 194/901

[58] Field of Search ..... 194/203, 344, 194/347, 348, 349, 351, 901; 453/5, 9; 232/7, 9–12, 15, 16

[56] References Cited

U.S. PATENT DOCUMENTS

| | | | |
|---|---|---|---|
| 1,268,723 | 6/1918 | Johnson | 232/7 |
| 3,338,510 | 8/1967 | Martinet | 232/7 X |
| 4,230,213 | 10/1980 | Spring | 194/348 |
| 4,960,196 | 10/1990 | Kanehara et al. | 194/901 X |
| 5,531,640 | 7/1996 | Inoue | 453/56 X |

*Primary Examiner*—F. J. Bartuska
*Attorney, Agent, or Firm*—Plevy & Associates

[57] ABSTRACT

The present invention involves a tamper-resistant guard for a coin-collection machine that receives coins and directs the coins toward a coin-collection machine, while the guard also protects the coin machine from pilfering. The tamper-resistant anti-theft guard has a cover which encloses the inlet opening of the coin-collection machine, and the cover has dual anti-theft coin guards, namely, a limited-access openings on its surface and baffles housed within it. The limited-access openings and the baffles prohibit or restrict the insertion of human hands, human fingers, or foreign objects into the cover or into the coin machine being protected.

14 Claims, 7 Drawing Sheets

TAMPER-RESISTANT ANTI-THEFT GUARD FOR COIN COLLECTION

FIELD OF THE INVENTION

This invention pertains to a tamper-resistant guard with dual anti-theft means that can be used to protect against the pilfering of coins from an automatic toll-collection system; more particularly, it involves a covering for a coin-collection machine that has both a limited-access means for enabling coins to be passed through the covering while barring foreign objects from entering the covering and a baffling means for obstructing the path of the coins from the limited-access means to the coin-collection machine.

BACKGROUND OF THE INVENTION

This invention relates to a tamper-resistant coin guard that may be used in connection with toll-collection systems commonly used on highways, bridges, tunnels, and the like. Many highways contain toll-collection systems to collect fares from their users. The toll revenue serves to defray the cost incurred in constructing or maintaining the highway, or it otherwise provides income to the operating entity.

In early toll-collection systems, attendants were employed to collect the fare from operators of vehicles and to regulate the tolls. Having attendants collect the fares caused numerous problems, however, in terms of efficiency and expense. For example, traffic delays resulted from the time consumed when the attendants collected the fares from the drivers; costs were incurred in hiring the attendants to operate the systems at all hours of the day and night; and losses were incurred through embezzlement of the coins by the attendants. As a result, devices were developed to automatically operate the toll-collection systems, that is, without the need for toll attendants. See U.S. Pat. No. 2,769,165 issued to Bower on Oct. 30, 1956, entitled "Automatic Toll-collection system"; U.S. Pat. No. 2,908,895 issued to Cooper on Oct. 13, 1959, entitled "Automatic Toll Operation System"; U.S. Pat. No. 3,090,941, issued to Breese on May 21, 1963, entitled "Toll Collecting Device"; and U.S. Pat. No. 2,646,215 issued to Stovall on Jul. 21, 1953, entitled "Automatic Toll Collector Device."

A standard automatic toll-collection system involves the use of a toll station or toll booth positioned between each lane of traffic so that vehicles driving on the highway must pass through a toll lane alongside a toll station. The passage of vehicles by the toll stations is monitored with light detectors, treadles, or other such devices capable of detecting passing vehicles. An automatic coin machine is connected to the toll station or toll booth, and the driver of the vehicle is required to place the required fare within the coin machine when passing by the toll station. The automatic coin machine registers the fare and operates toll gates or traffic signals associated with the toll lane, such as green, red, or flashing violation lights.

A standard automatic coin machine that is used in such a toll-collection system is typically equipped with a receiving means for accepting the coins from the vehicle operators and depositing them into the inlet opening of the coin machine. The coin machine often involves a metering device or meter box connected to a circuit for operating the traffic signals. The receiving means typically involves an open basket or coin hopper in which coins are tossed by motorists. The hopper is placed above the coin machine or metering device so that once the coins are received by the hopper, the hopper funnels the coins into the inlet opening of the coin machine, which then registers the fare and activates the traffic signals. See, for example, the toll-collection devices disclosed in U.S. Pat. No. 3,070,293 issued to Rosapepe, Dec. 25, 1962, entitled "Toll Collection Boxes"; U.S. Pat. No. 3,018,469 issued to Grant, Jan. 23, 1962, entitled "Fare Collection and Signal System for Toll Roads"; and U.S. Pat. '215 to Stovall, referenced above.

Typically, the coin machine (or metering device) is securely located within the toll booth near the ground surface. The toll booth often is designed so that a portion of the toll booth wall extends outwardly toward the toll lane; this extension of the toll booth wall is referred to as a blister, and the coin machine is often placed within this blister. The receiving means or coin hopper is placed above the coin machine, but it is also attached to the outside of the toll booth, such that it is easily accessible to passing motorists. There is an opening in the blister (the exterior surface of the toll booth wall), so that the neck of the hopper can be connected to the inlet of the coin machine. For an illustration, see FIG. 2 of U.S. Pat. '293 to Rosapepe, referenced above.

In recent years, theft of toll revenue from automatic toll-collection systems has been a problem, particularly at night when toll stations are unattended. Thieves have, for example, stuffed material into the coin hoppers to prevent coins from being funneled into the coin machine; the coins would then collect in the hopper so that the thieves could retrieve them at a later time. Another method that has been used to pilfer coins from toll-collection systems is to put adhesive on the end of a wire and to then insert the adhesively-coated wire down the hopper and into the coin machine; using this method, the adhesive causes the coins to stick to the wire, and the coins are retrieved when the wire is pulled up out of the device. Besides wire, string and fishing poles have been used as well.

The thieveries have been problematic not only in terms of reducing revenue received from the automatic toll-collection systems, but also in causing damage to the toll devices and jeopardizing the safety of toll collectors and motorists who may be confronted by loitering thieves and vandalists. The theft problem can be addressed by hiring private security guards or boosting police patrols at the toll stations, but these means are not cost-effective.

Previous toil-collection systems do not incorporate anti-theft mechanisms designed to address these problems. Generally, prior art automatic toll-collection systems use open hoppers as the receiving means, thus exposing the system to vandalism, as discussed above. See Pat. '469 to Grant, '469, Pat. '293 to Rosapepe, and Pat.'215 to Stovall, all referenced above. The system disclosed in Rosapepe '293 contains a hood pivotally attached to the hopper; however, the primary objective of the hood is to provide a hopper that is weatherproof, not one that is resistant to vandals, and the hood is not securely attached to the hopper at all edges. In U.S. Pat. No. 3,716,183, issued to Chaves on Feb. 13, 1973, entitled "Parking Lot Coin Receptacle," there are slots at the receiving end as opposed to an open hopper. However, the invention disclosed in that patent is addressed to a coin receptacle to be placed in a parking lot, and it is not suitable for use in an automatic toll-collection system to be placed along a highway: it has a large number of individualized and separately located slots for each of the parking spaces in the lot which would not be readily accessible to passing motorists. Also, the screening mechanism in Chaves '193 allocates the coins to parking lot spaces, and once the coins are deposited, access to the coins is restricted with a dead bolt lock over a closure plate on the outside of the coin receptacle, such that a thief or vandalist could easily locate the portion of the apparatus at which the coins are held.

Earlier attempts to improve standard toll-collection systems for the prevention of theft and vandalism were unsuccessful. For example, metal hoppers were fabricated with a single anti-theft means, that is, grillage bars were located inside the hopper to screen the opening at the neck of the hopper. This adaptation led to further vandalism; thieves and vandals employed more ingenuous methods of blocking the hopper such as, for example, using liquid-based materials. The single anti-theft means was therefore unsuccessful and only resulted in more damage, as the use of liquid materials was more damaging to both the hoppers and the automatic coin machine as compared with the materials that are used to block the hoppers of the traditional automatic toll-collection systems.

Thus, as the above background reveals, there is a need for an improved automatic toll-collection system that is resistant to tampering and secure against obstruction, damage, hampering, or other vandalism or theft. Additionally, it is desirable to provide an automatic toll-collection system that is not only resistant to theft but which is also durable and reliable; easy and economical to fabricate, install, and maintain; and easy to use, such that use of the system does not cause undue traffic delays. The present invention provides such an improved automatic toll-collection system by providing a tamper-resistant guard for a coin-collection machine that has dual anti-theft means and that can also serve as the receiving means in place of or in addition to the open hopper traditionally used.

SUMMARY OF THE INVENTION

Summarily described, the invention embraces a tamper-resistant guard that has dual anti-theft means to protect a coin-collection machine from pilfering. The tamper-resistant anti-theft guard also receives coins and directs them toward an inlet opening of the coin-collection machine. More specifically, the tamper resistant guard has a covering means which encloses the inlet opening of the coin-collection machine, thereby barring access to the coin machine. The covering means has a limited-access means on its surface and a baffling means housed within it. The limited-access means allows for coins to be inserted into the covering means but prevents larger objects, such as human hands or fingers, from being inserted into it. The baffling means receives the coins from the limited-access means and directs them along a tortuous path, thus obstructing the coin path so that vandals cannot see a coin hopper or coin machine within the covering means and they cannot insert narrow foreign objects, such as wire or fishing poles, into the coin machine.

The tamper-resistant guard of the present invention can be used with automatic toll-collection systems along highways, bridges, tunnels, or the like, to provide a dependable and secure means of automatically collecting toll revenue. The guard can be formed from an extension of a toll booth wall or blister, or it can be formed as a separate covering that is either welded to the toll booth or placed on top of an existing hopper and coin-collection machine. Thus, the present invention is readily adaptable to existing toll-collection systems to render such systems more resistant to theft and vandalism.

BRIEF DESCRIPTION OF THE DRAWINGS

For a better understanding of the present invention, an exemplary embodiment of the invention is described below, considered together with the accompanying drawings, in which.

DETAILED DESCRIPTION OF THE DRAWINGS

Figure 1:
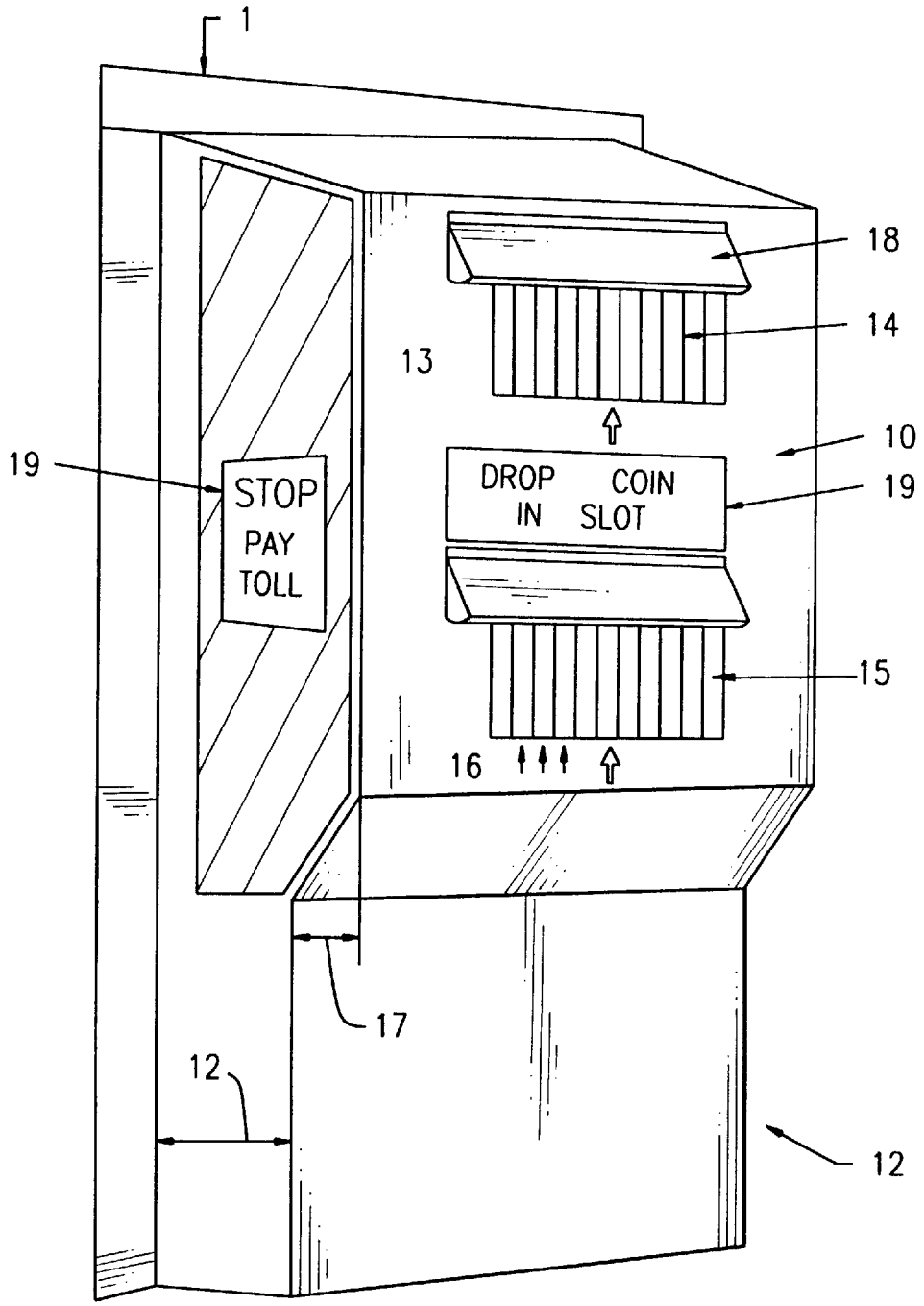
FIG. 1 illustrates one preferred embodiment of the external surface of the present invention, depicting the front and side view of the tamper-resistant guard extending from a toll booth wall.
Figure 2:
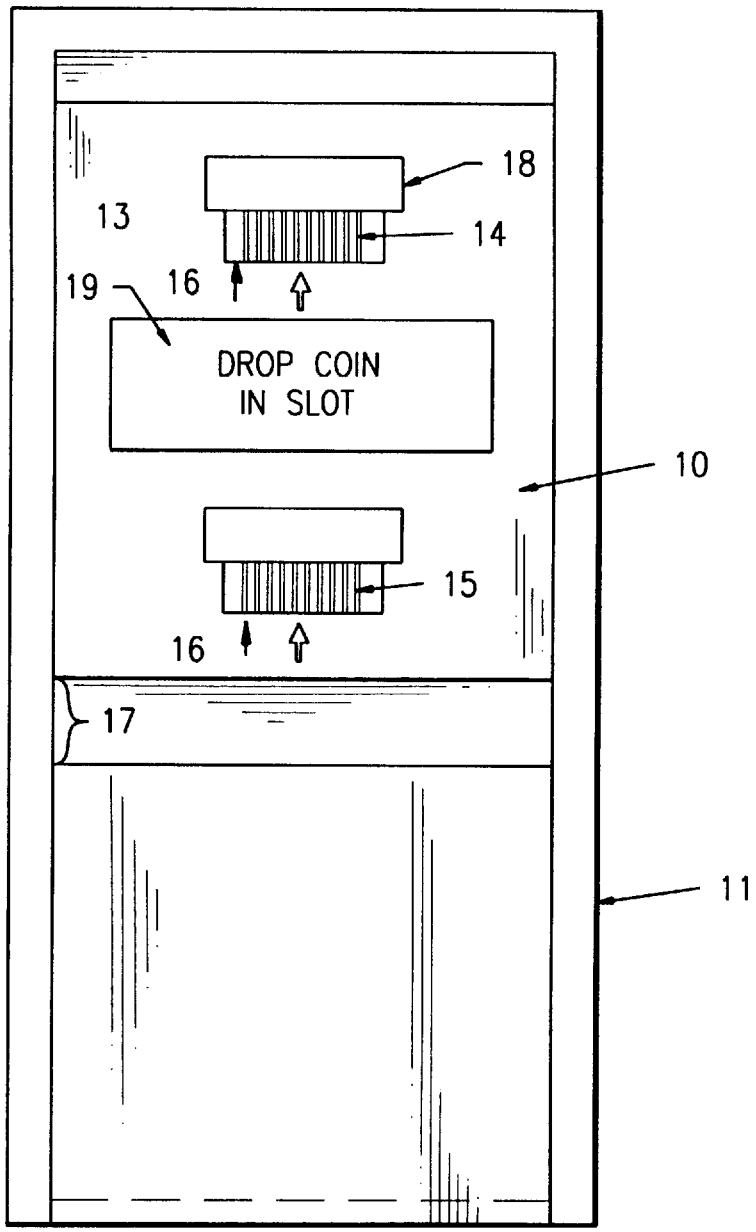
FIG. 2 is a front view of the external surface of one preferred embodiment of the present invention.

Referring to FIGS. 1 and 2, there is shown the coin guard or covering 10 in a generally rectangular shape extending from the wall of a toll station 11. The covering can be bolted or welded to the toll station, or it can be formed as an extension of the toll booth wall. It is shown having two side panels 12 which extend outwardly from the toll booth wall and having a front surface or wall 13 which is positioned to face a motorist passing through a toll lane. Although the coin guard is shown having a rectangular shape with two side panels, it can take other forms as well; for example, it can be dome-shaped or take the shape of a half-cylinder or half-cone extending from the toll booth wall.

The surface of the coin guard has two openings, an upper opening 14 and a lower opening 15. The upper and lower openings 14 and 15 are provided at different heights to enable drivers of various sized-vehicles, such as cars and busses, to obtain convenient access to the openings for depositing coins or tokens. The openings are traversed with rods 16, which are spaced apart to enable passing motorists to readily deposit coins between them. The rods are shown vertically traversing the openings but may be horizontally positioned as well. They also may be criss-crossed, or a screen or meshed wire may be substituted for the rods, with the main aspect being that the spaces remaining in the openings be sufficient in size to permit the convenient insertion of coins but insufficient to permit the insertion of human hands or fingers. The openings considered together with the means of limiting access through them, be it by way of rods, a grille, a screen, meshed wire, or the like, can be referred to in combination as coin slots, and they will be so referenced herein.

Referring to FIG. 1, the side panels 12 of the coin guard are shown with an increased width 17 at an upper section of the coin guard, such that the face of the upper section of the coin guard will protrude further in the direction of a passing motorist than the face of the lower section. This extension of the side panel is provided to enhance the accessibility of the coin slots to passing motorists. A drip cap 18 may be placed above the coin slots to protect against rain or snow and to further limit the range of mobility of any tools or objects that a thief or vandal may attempt to insert inside the coin guard. Instructional signs or labels 19 are shown affixed to the surface and side panels. Preferably, both the side panels 12 and the surface 13 are constructed of steel or steel plates.

Figure 3:
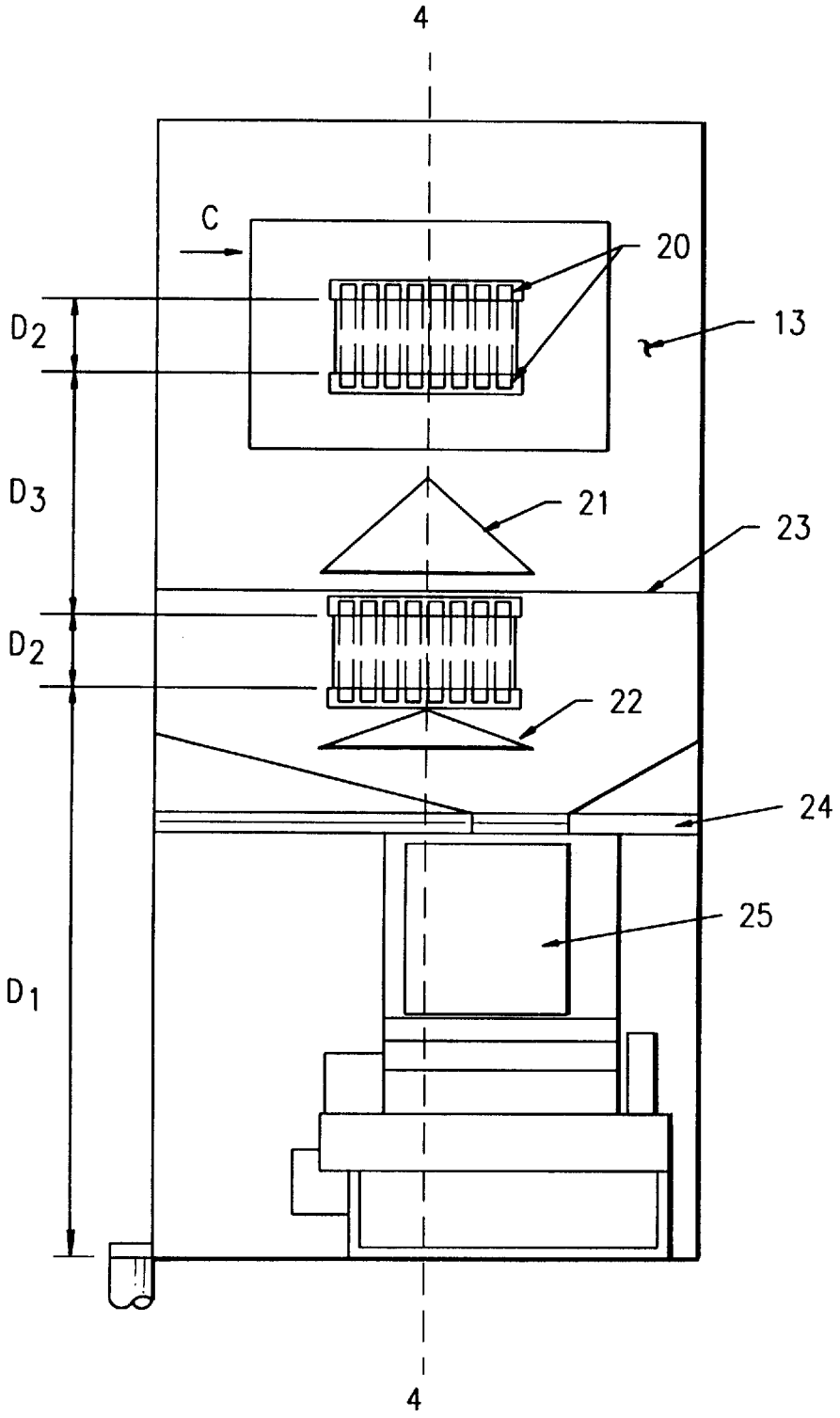
FIG. 3 illustrates the internal structure of one preferred embodiment of the present invention, looking at the tamper-resistant guard from the direction opposite the face of FIG. 2 from within a toll booth (a rear view).
Figure 4:
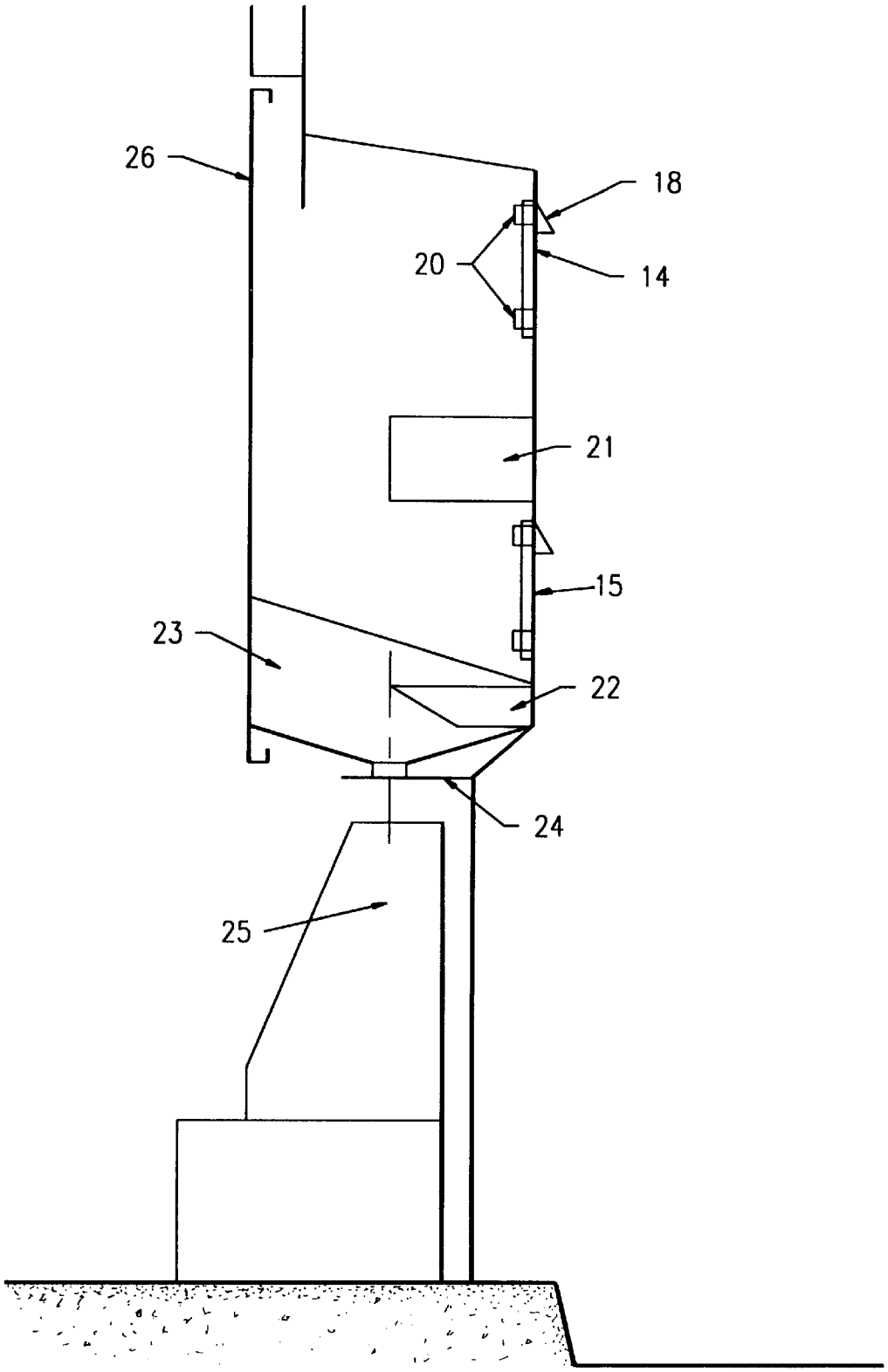
FIG. 4 is a cross-sectional view of the invention along the reference line A—A in FIG. 3.

Referring now to FIGS. 3 and 4, there is shown the internal structure of the coin guard. A cross bar 20 is shown horizontally across the top and bottom of the openings 14 and 15 on the inside of the coin guard. The cross bars are preferably housed within the coin guard, to prevent thieves or vandals from accessing them, but they may be located outside the coin guard also. The cross bars serve to hold the rods traversing the openings, as further described in connection with FIGS. 5 and 6, below.

Referring still to FIGS. 3 and 4, there is shown within the coin guard an upper baffle 21 and a lower baffle 22. The upper and lower baffles 21 and 22 are positioned beneath the openings 14 and 15, respectively. The baffles are shown having a wedged or polygonal shape; they have two inclined side planes, with the vertex of the two planes meeting at a common point. Preferably, this common point is directed upward with the central axis of the baffle being orientated perpendicular to the ground surface, following the reference line A—A on FIG. 3. The apex of the baffle is preferably aligned with the horizontal mid-section of the openings 14 and 15.

Figure 4A:
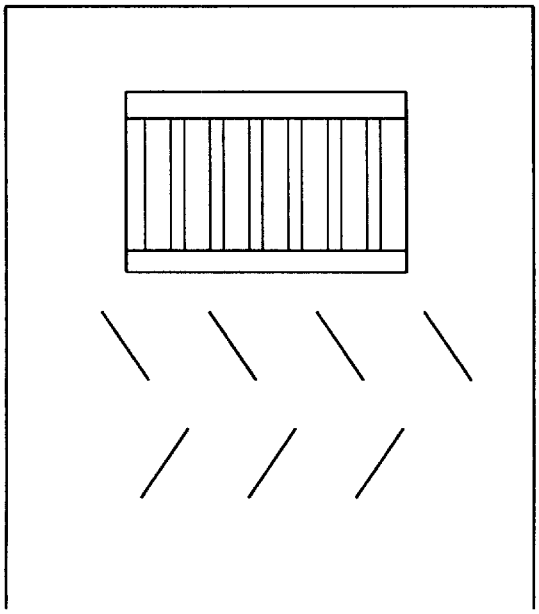
FIGS. 4A and 4B illustrate two embodiments of the baffles, looking at the tamper-resistant guard from the direction opposite the face of FIG. 2 form within a toll booth.
Figure 4B:
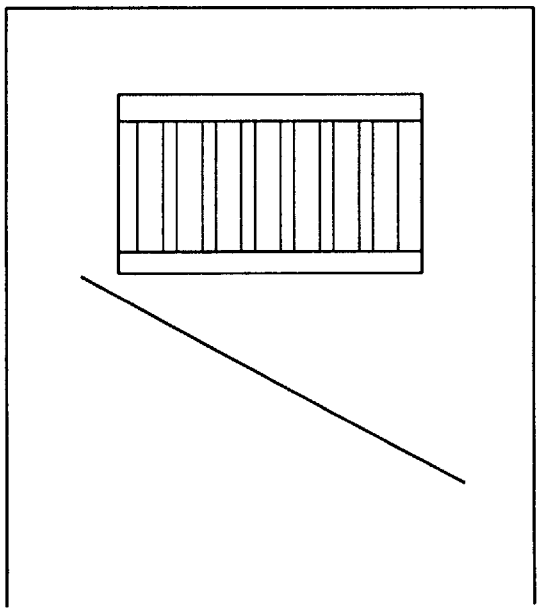

The baffles may be bolted or welded onto the surface 13 of the coin guard. They are preferably made of steel or a similar material which is difficult to puncture, but they can be made of any smooth material which would allow for coins to slide or roll down the material when a slab or flat strip of the material is placed on an incline. The baffles also may be formed in configurations besides those shown. For example, the baffles can be formed as a plurality of singular inclined planes orientated partially across the length of the openings as shown in FIG. 4A, or they can be formed as single inclined planes orientated fully across the length of the openings as shown in FIG. 4B. The main consideration in configuring the baffles is that they obstruct the coin path between the coin slots and the automatic coin machine and invoke the force of gravity in directing the coins along this tortuous path.

Referring now back to FIGS. 3 and 4, disposed beneath the baffles is a hopper or coin basket 23, and beneath the hopper is the automatic coin machine 25, with the neck of the hopper being connected to the coin machine. A separate shelf 24 may be provided between the hopper 23 and automatic coin machine 25 to hold the hopper in place, with an aperture being placed in the shelf to allow the neck of the hopper to funnel into the coin machine. Alternatively, the base of the coin guard may be positioned along the shelf line 24, in which case the coin machine would be placed outside the coin guard but preferably still housed within the toll booth or behind the toll booth wall. Referring to FIG. 4, a door panel 26 may be substituted for the rear wall of the coin guard, secured with a lock, to provide access to the inside of the coin guard to inspect the collection process or check for problems.

Referring still to FIGS. 3 and 4, when a passing motorist deposits coins through the openings 14 or 15, the coins fall onto the baffles 21 and 22. The coins will then roll or slide down the baffles along a tortuous path into the hopper 23. The hopper then funnels the coins and empties them into the inlet of the coin machine 25 for registering the fare and activating the traffic signals. Preferably, the mouth of the hopper 23 extends upwardly within the coin guard; at the front of the coin guard, the mouth of the hopper is placed beneath the lower coin slot, but at the rear of the coin guard, the mouth of the hopper extends further upwardly to deflect or catch coins that may bounce off the baffles. The side planes of the baffles preferably slope at forty-five degree angles, as reflected by the upper baffle 21 in FIGS. 3 and 4. This is the preferred angle for increasing the speed at which the coins slide down the baffles while also obstructing the path between the coin slots and the coin machine. In the embodiment depicted in FIGS. 3 and 4, the lower baffle 22 is shown sloping at an increased angle; the angle of the lower baffle is increased to accommodate the hopper 23 and the coin machine 25 while also keeping the distance D1 in FIG. 3 (reflecting the distance between the ground and the lower opening 15) at three feet, which is the preferred distance for enabling a motorist in a standard vehicle to access the lower opening.

Figure 5:
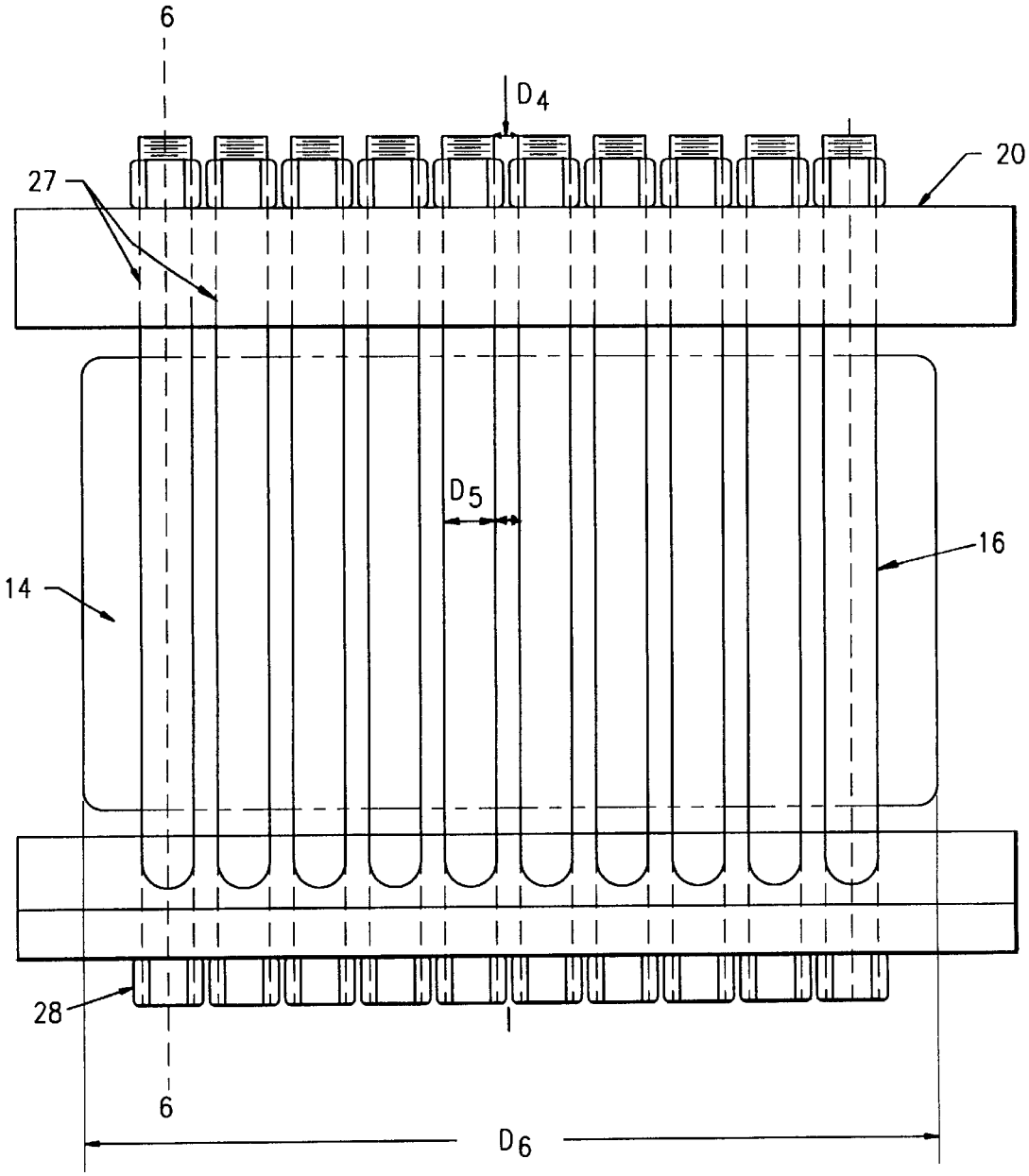
FIG. 5 is an exploded view of an opening in the surface of the tamper-resistant coin guard, showing a detailed view of the rods traversing the opening.
Figure 6:
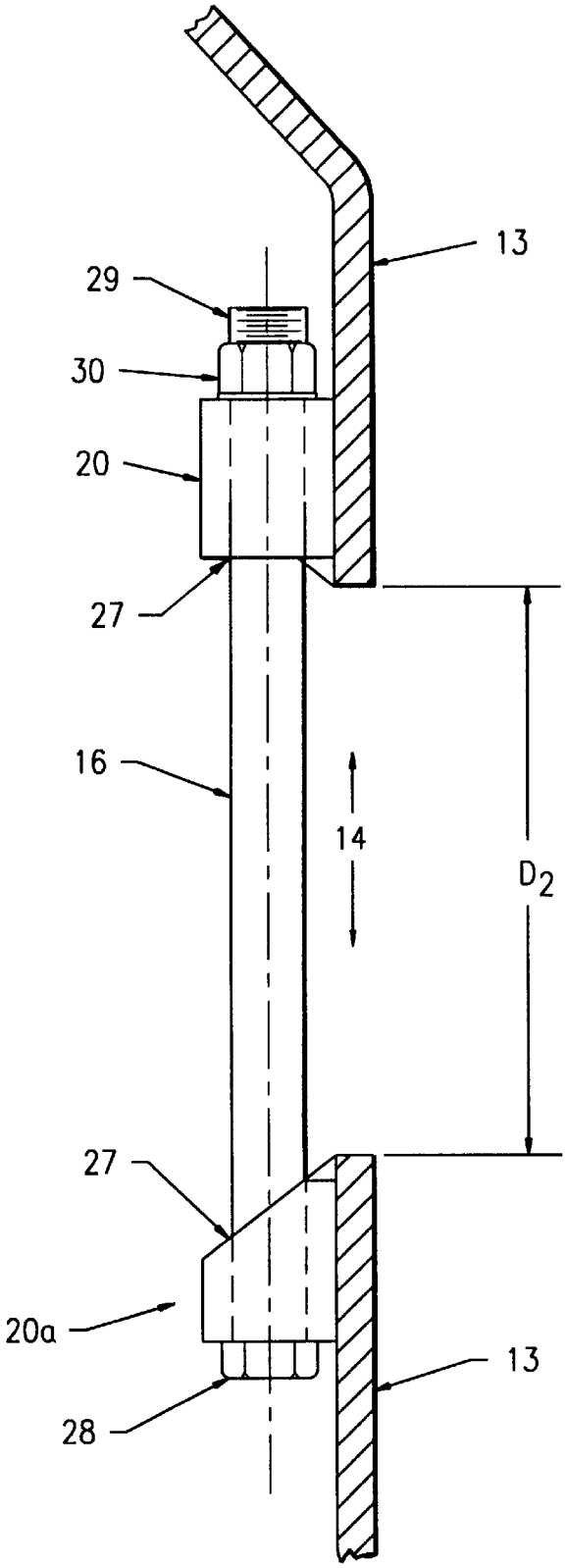
FIG. 6 is a cross-sectional view of one rod traversing an opening taken along the reference line B—B in FIG. 5.

Referring now to FIG. 5, there is shown a more detailed view of the coin slots looking from within the coin guard at the boxed region C in FIG. 3. In FIG. 6, there is shown a more detailed cross-sectional view of one rod along the reference line B—B of FIG. 5. Referring to FIGS. 5 and 6, cross bars 20 and 20*a* are shown welded to the internal side of the coin guard surface 13, just above and below the opening 14. The top surface of the lower cross bar 20*a* is chamfered or beveled so that coins inserted through the spaces between the rods do not become lodged on the cross bar. The cross bars 20 and 20*a* contain holes 27 through which the rods 16 may be inserted. The diameter of the holes 27 are preferably larger than the diameter of the rods 16, so that the rods remain free to rotate, thereby preventing thieves or vandals from attempting to unscrew the rods. The rods are shown in the shape of a bolt, with one end of the rod having a head 28 and the other end having threads 29. A nut 30 is screwed onto the threads of the rod to secure the rod on the cross bar.

The dimensions of the coin guard, including the dimensions of the surface of the guard, the coin slots, and the baffles, can be adjusted to provide greater ease of access for motorists of differing vehicles. However, greater ease of access by motorists may also translate to greater ease of access by vandalists and thieves, and a balancing of these factors may be appropriate. With regard to preferred dimensions, referring now to FIGS. 3 and 5, the distance D1 in FIG. 3 (reflecting the distance between the ground level to the base of the lower opening 15), is three feet. Preferably, the distance D2 in FIGS. 3 and 5 (reflecting the height of the openings 14 and 15), is 4 inches. The distance D3 shown in FIG. 3 (reflecting the distance between the top of the lower opening 15 and the base of the upper opening 14), is preferably one-and-one-half feet. The distance D4 (reflecting the spacing between the rods), is preferably one-quarter inch. The distance D5 as shown on FIG. 5 (reflecting the diameter of the rods), is preferably one-half inch. The distance D6 shown in FIG. 5 (reflecting the width of the openings 14 and 15), is preferably nine inches.

It will be understood that the embodiment described herein is merely exemplary and that a person skilled in the art may make variations and modifications without departing from the spirit and scope of the invention. More specifically, it should be understood that although the preferred embodiment shown involves a coin guard connected to a automatic toll-collection machine used on highways, the tamper-resistant guard of the present invention may be used in connection with other collection devices. Additionally, although the preferred embodiment shown reflects a boxed surface with rectangular coin slots, coin guards having openings with other sizes and shapes may be used. Also, the coin slots can be placed on a horizontal surface of the coin guard, as opposed to the vertical surface as shown. All such variations and modifications are intended to be included within the scope of the appended claims.

We claim:

1. A tamper-resistant anti-theft coin guard for receiving coins and directing them toward the inlet opening of a coin-collection machine, comprising:

(a) a covering means for enclosing said inlet opening of a coin-operated machine comprising a front coin receiving surface;

(b) a limited-access means comprising:

an opening in said front coin receiving surface;

a first rectangular crossbar coupled to an inner surface of said front coin receiving surface on a first side of said opening, said first crossbar having a plurality of holes orientated across its length;

a second rectangular crossbar coupled to said inner surface of said front coin receiving surface positioned on a second, opposite side of said opening from said first crossbar, said second crossbar having a plurality of holes orientated across its length; and, a plurality of rods having first and second ends, respectively; wherein each of said plurality of rods is passed through a hole selected from said plurality of holes in said first crossbar, and through a hole selected from said plurality of holes in said second crossbar, such that said first crossbar secures said first end of each of said plurality of rods to the inner surface of the front coin receiving surface, said second crossbar secures said second end of each of said plurality of rods to the inner surface of the front coin receiving surface, and said plurality of rods traverse said opening;

wherein, said rods are positioned for allowing coins to, while preventing human fingers from, passing through said opening; and (c) a baffling means contained within said covering means for receiving coins from said limited access means and directing the coins along a tortuous path toward the inlet opening of the coin-collection machine so that said baffling means obstructs the coin path from said limited-access means to the coin-collection machine.

2. The coin guard according to claim 1, wherein the plurality of rods are free to rotate within the holes of the rectangular crossbars.

3. The coin guard according to claim 1, wherein the baffling means further comprises the force of gravity directing the coins along the tortuous path toward the coin-collection machine.

4. The coin guard according to claim 1, wherein the baffling means further comprises at least one inclined plane housed within the covering means and disposed beneath the limited-access means so that coins inserted through the limited-access means into the covering means fall to at least one inclined plane and slide downwardly along the plane toward the coin-collection machine.

5. The coin guard according to claim 3, wherein the baffling means further comprises at least one pair of inclined planes joined at a common vertex whereby each pair of inclined planes forms a wedge, and wherein the common vertex of the wedge so formed points upwardly in the direction of the limited-access means so that coins deposited into the covering means through the limited-access means fall onto at least one of the pair of inclined planes and slide downwardly toward the coin-collection machine.

6. The coin guard according to claim 1, further comprising a funneling means for receiving coins from the baffling means and depositing the coins into the inlet opening of the coin-collection machine.

7. The coin guard according to claim 6, wherein the funneling means further comprises a hopper having a mouth and a neck, the hopper being housed within the covering means, with the neck of the hopper coupled to the inlet opening of the coin-collection machine and the mouth of the hopper extending upwardly within the covering means.

8. The coin guard according to claim 1, wherein the covering means further comprises a rear vertical surface, the front coin receiving surface comprising a blister to a toll booth wall, and the rear vertical surface comprising a door for providing a means of access to the inside of the covering means.

9. The coin guard according to claim 1, wherein the covering means further comprises a closed container having an aperture at its base coaxially aligned with the inlet opening of the coin-collection machine for the depositing of coins from the container into the inlet opening of the coin-collection machine.

10. A tamper-resistant coin guard for receiving coins and directing them toward the inlet opening of a coin-collection machine, comprising:

(a) a covering means having at least one vertical surface for enclosing the inlet opening of the coin-collection machine;

(b) a plurality of limited-access means differentially disposed on the vertical surface of the covering means for enabling operators of vehicles having differing heights to access at least one of the limited-access means while seated in their vehicles; each of said plurality of limited access means comprising:

an opening in said at least one vertical surface;

a first rectangular crossbar coupled to an inner surface of said at least one vertical surface on a first side of said opening, said first crossbar having a plurality of holes orientated across its length;

a second rectangular crossbar coupled to said inner surface of said at least one vertical surface positioned on a second, opposite side of said opening from said first crossbar, said second crossbar having a plurality of holes orientated across its length; and, a plurality of rods having first and second ends, respectively; wherein each of said plurality of rods is passed through a hole selected from said plurality of holes in said first crossbar, and through a hole selected from said plurality of holes in said second crossbar, such that said first crossbar secures said first end of each of said plurality of rods to the inner surface of said at least one vertical surface, said second crossbar secures said second end of each of said plurality of rods to the inner surface of said at least one vertical surface, and said plurality of rods traverse said opening;

wherein, said rods are positioned for allowing coins to, while preventing human fingers from, passing through said opening; and, (c) a plurality of baffling means housed within the covering means for receiving coins from the plurality of limited-access means and directing the coins along a tortuous path within the covering means toward a coin-collection machine.

11. The coin guard according to claim 10, wherein the baffling means further comprises at least one inclined plane housed within the covering means and disposed beneath said plurality of limited access means, so that coins inserted through any of said plurality of limited access means into the covering means fall to at least one inclined plane and slide downwardly along the at least one plane toward the coin-collection machine.

12. A tamper-resistant coin guard for receiving coins and directing them to a coin-collection machine, comprising:

(a) a covering that extends above a coin-collection machine and encloses the inlet opening of the coin-collection machine, the covering having at least one front coin receiving surface;

(b) a limited-access means comprising:

an opening in said at least one front coin receiving surface;

a first rectangular crossbar coupled to an inner surface of said at least one front coin receiving surface on a first side of said opening, said first crossbar having a plurality of holes orientated across its length;

a second rectangular crossbar coupled to said inner surface of said at least one front coin receiving surface positioned on a second, opposite side of said opening from said first crossbar, said second crossbar having a plurality of holes orientated across its length; and, a plurality of rods having first and second ends, respectively wherein each of said plurality of rods is passed through a hole selected from said plurality of holes in said first crossbar, and through a hole selected from said plurality of holes in said second crossbar, such that said first crossbar secures said first end of each of said plurality of rods to said inner surface, said second crossbar secures said second end of each of said plurality of rods to said inner surface, and said plurality of rods traverse said opening;

wherein, said rods are positioned for allowing coins to, while preventing human fingers from, passing through said opening; and, (c) at least one baffle housed within the covering and disposed beneath at least one coin slot, the at least one baffle having at least one inclined plane so that coins inserted into the covering through a coin slot fall to a baffle and slide downwardly along the baffle toward the coin-collection machine.

13. The coin guard according to claim 12, further comprising a hopper with a mouth and a neck, the hopper being housed within the covering and above the coin-collection machine, with the neck of the hopper coupled to the inlet opening of the coin-collection machine and the mouth of the hopper extending upwardly within the covering for the funneling of coins from the baffles to the inlet opening of the coin-collection machine.

14. The coin guard according to claim 12, wherein the covering further comprises a rear vertical surface, said at least one front coin receiving surface being integrally attached to a toll booth wall, and the rear vertical surface comprising a door for providing a means of access to the inside of the covering.

* * * * *